US008770408B2

(12) United States Patent
Tschantz et al.

(10) Patent No.: US 8,770,408 B2
(45) Date of Patent: Jul. 8, 2014

(54) MULTI-CHAMBER INFLATABLE PACKAGING CUSHION AND METHOD OF INFLATION THEREOF

(76) Inventors: Michell C. Tschantz, Newtown, CT (US); Kerry M. McKinley, Newtown, CT (US)

( * ) Notice: Subject to any disclaimer, the term of this patent is extended or adjusted under 35 U.S.C. 154(b) by 0 days.

(21) Appl. No.: 13/134,550

(22) Filed: Jun. 8, 2011

(65) Prior Publication Data

US 2012/0067760 A1 Mar. 22, 2012

Related U.S. Application Data

(60) Provisional application No. 61/397,264, filed on Jun. 8, 2010.

(51) Int. Cl.
*B65D 81/03* (2006.01)

(52) U.S. Cl.
USPC ..... 206/522

(58) Field of Classification Search
USPC ..... 206/522
See application file for complete search history.

(56) References Cited

U.S. PATENT DOCUMENTS

| | | | | |
|---|---|---|---|---|
| 7,168,115 | B2 * | 1/2007 | Davis | 5/655.3 |
| 2001/0001921 | A1 * | 5/2001 | Sperry et al. | 53/403 |
| 2006/0272288 | A1 * | 12/2006 | Kannankeril | 53/403 |
| 2007/0163916 | A1 * | 7/2007 | Yoshifusa | 206/522 |
| 2008/0035519 | A1 * | 2/2008 | Swartz et al. | 206/522 |
| 2008/0095474 | A1 * | 4/2008 | Liao et al. | 383/3 |

* cited by examiner

*Primary Examiner* — Steven A. Reynolds
*Assistant Examiner* — King M Chu
(74) *Attorney, Agent, or Firm* — Ware, Fressola, Maguire & Barber LLP

(57) ABSTRACT

An inflatable packaging cushion has an inflation manifold connected to inflatable chambers through check valves. The inflation manifold mounts an inflation plate defining an aperture. Placing the end of an inflation tube on the inflation plate inflates the manifold and the inflation chambers through the check valves. This eliminates the need to insert an inflation tube through an opening in the polymer sheet forming the manifold, and the inflation tube placement may be automated.

16 Claims, 4 Drawing Sheets

MULTI-CHAMBER INFLATABLE PACKAGING CUSHION AND METHOD OF INFLATION THEREOF

RELATED APPLICATION

This application claims priority to our U.S. Provisional Application Ser. No. 61/397,264 filed Jun. 8, 2010, which is incorporated herein by reference.

FIELD OF INVENTION

The invention herein relates to a multi-chamber inflatable packaging cushion with an inflation manifold and to apparatus and methods for introducing inflation air to the inflation manifold.

BACKGROUND OF INVENTION

Multi-chamber inflatable packaging cushions with a single inflation point are known. They typically have a plurality of aligned individual inflatable chambers, with each chamber having a self-sealing inflation check valve at one end. A manifold extends across the ends of the chambers in communication with the inflation check valves, and the manifold has an opening at one end thereof for receiving an inflation tube. The inflation tube delivers air to the manifold, and the air passes through the individual inflation check valves to inflate the individual chambers. The result is an inflated multi-chamber packaging cushion.

A significant disadvantage of such known multi-chamber inflatable packaging cushions is the difficulty in engaging an inflation tube with the manifold. This function requires simultaneously manipulating the manifold portion of the packaging cushion and inserting the inflation tube, which is a two-handed manual operation. This substantially limits any opportunity for automated inflation of the packaging cushions, and also requires careful attention for successful manual inflation.

Although the foregoing difficulties are usually associated with multi-chamber inflatable packaging cushions, a single chamber inflatable packaging cushion may also require insertion of an inflation tube into an inflation valve, which may be difficult to accomplish in some circumstances.

Accordingly, improvement in the structure and way that inflatable packaging cushions are inflated would be a welcome improvement in the art.

SUMMARY OF THE INVENTION

It is a principal object of the invention herein to provide an improved multi-chamber inflatable packaging cushion.

It is an additional object of the invention herein to provide an improved multi-chamber inflatable packaging cushion which is easily inflated.

It is another object of the invention herein to provide a multi-chamber inflatable packaging cushion with an improved interface with an inflation tube.

It is also an object of the invention herein to provide an improved multi-chamber inflatable packaging cushion that is adapted for automated inflation.

It is another principal object of the invention herein to provide a method of inflating a multi-chamber inflatable packaging cushion.

It is a further principal object of the invention to provide for easy inflation of inflatable packaging cushions.

In carrying out the invention herein, an inflatable packaging cushion of the type having at least one and generally a plurality of individual inflatable chambers each having a self-sealing inflation check valve at one end thereof and a manifold in communication with the inflation check valves. The manifold is formed between upper and lower layers of polymer sheet material and is provided with a substantially rigid inflation plate mounted on the upper layer of the polymer sheet material forming the manifold. The inflation plate has an aperture registered with an inflation opening through the polymer sheet material to the manifold. Inflation is accomplished by supporting the manifold on a surface and placing an end of an inflation tube in air communication with the inflation plate. Inflation air enters the manifold through the aperture and inflation opening and displaces the inflation plate and upper layer of polymer sheet material from the lower layer of the polymer sheet material. This opens the inflation manifold for delivering air to the interior of the inflation manifold and to the inflation check valves for inflating the at least one chamber. In a preferred embodiment, the manifold extends across the ends of a plurality of aligned chambers.

According to a method of the invention, at least the portion of the inflation manifold to which the inflation plate is secured, is placed on a support surface with the inflation plate at a pre-determined location and an inflation tube is placed on the inflation plate by manual or automated placement means.

In aspects of the invention, the inflation plate is an annular disk. The inflation plate may have other shapes, including an elongated oval shape, and an annular disk with opposed extension tabs. The end of the inflation tube may be placed on the inflation plate.

In a further aspect of the invention, the inflation plate has an upstanding placement flange adjacent the aperture and inflation opening. The placement flange cooperates with the inflation tube to position and maintain the inflation tube in air communication with the aperture and inflation opening. The placement flange may be continuous or segmented.

In further aspects of the invention, the inflation tube has an extending tip that is received in the aperture of the inflation plate, for positioning the inflation tube with respect to the aperture and the inflation opening to the inflation manifold.

The foregoing and other objects and features of the invention herein will in part be apparent to those skilled in the art and will in part appear in the following detailed description and claims, taken together with the drawings.

DRAWINGS

The same reference numerals refer to the same elements throughout the various figures.

DETAILED DESCRIPTION OF INVENTION

Figure 1:
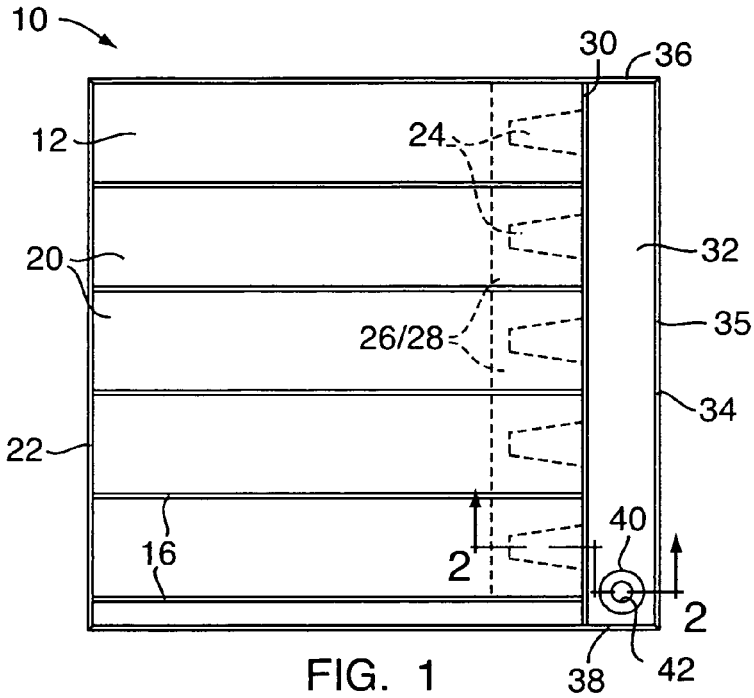
FIG. 1 is a plan view of a multi-chamber inflatable packaging cushion according to the invention herein.

With reference to FIGS. 1-6, a multiple chamber inflatable packaging cushion 10 according to the invention herein is illustrated. The packaging cushion 10 is fabricated of upper and lower sheets of polymer material 12 and 14, which is preferably a thermoplastic material so that seams and connections can be formed by heat fusion or welding. A plurality of seams 16 define a plurality of elongated inflatable chambers 20, which are closed at a distal end 22 either by a fold between integral upper and lower thermoplastic sheets 12 and 14 or by an end seam. At the opposite ends of the inflatable chambers 20, a plurality of one-way self-sealing inflation check valves 24 are mounted, with each inflation check valve 24 positioned to deliver inflation air to a respective inflatable chamber 20.

Although the inflation chambers 20 are shown as individual elongated chambers, they may be provided with spot seams to divide the inflatable chambers into sections. Also, the spot seams may be aligned to form fold lines for fitting the inflatable packaging cushion around a carton or product.

Figure 2:
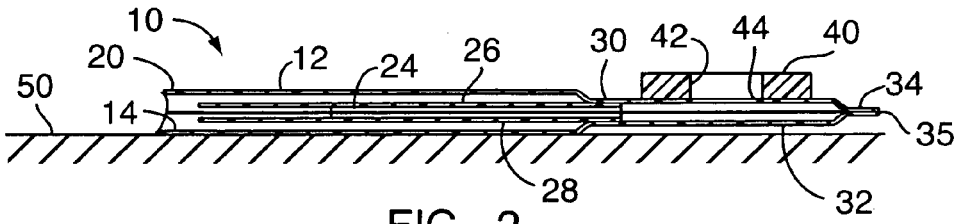
FIG. 2 is an enlarged fragmentary sectional view of the multi-chamber inflatable packaging cushion of FIG. 1, taken along the lines 2-2 of FIG. 1.
Figure 3:
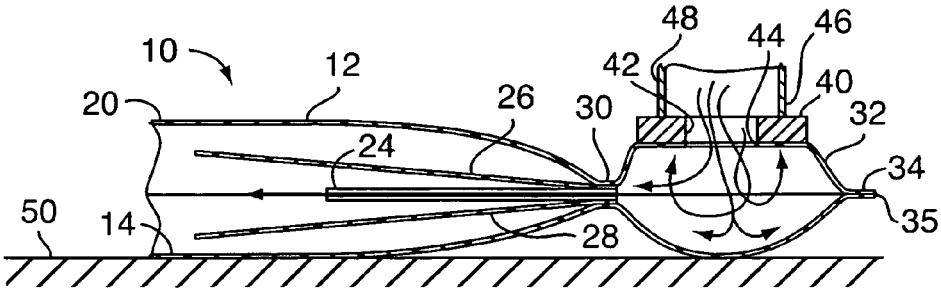
FIG. 3 is also an enlarged fragmentary sectional view of the multi-chamber inflatable packaging cushion of FIG. 1, taken along the lines 2-2 of FIG. 1, and with an inflation tube engaged with the inflatable packaging cushion and the inflatable packaging cushion being inflated.

The inflation check valves 24 are of the type having a flat tube that is opened by inflation air to provide the inflation air to the inflatable chambers 20, and the flat tubes of the inflation check valves 24 are self-sealed by air pressure within the inflatable chambers 20 after inflation has been accomplished. With reference to FIGS. 2 and 3, the inflation check valves are provided between two sheets 26 and 28 which position the inflation check valves at a desired spacing, so that the sheets 26 and 28 with the inflation check valves 24 attached may be positioned and secured between the upper and lower polymer sheets 12 and 14 as the inflatable packaging cushion 10 is being manufactured. The upper and lower polymer sheets 12 and 14 are secured together with the sheets 26, 28 and the inflation check valves 24 therebetween by a seam 30. The inflation check valves 24 are made with a heat-resistant coating so that an inflation path through the check valves 24 remains open as the seam 30 is formed, as is known in the art.

The upper and lower polymer sheets 12 and 14 extend from the seam 30 to form an elongated inflation manifold 32 having the seam 30 along one side thereof and a second seam or integral fold 34 of the upper and lower polymer sheets forming the other side 35 of the manifold 32. The ends of the manifold 32 are closed by end seams 36 and 38. The manifold 32 is in air communication with all of the inflation check valves 24, for delivering inflation air through the check valves and into the inflatable chambers 20.

An inflation plate 40 is secured to the upper polymer sheet 12 forming the manifold 32. The inflation plate 40 is in the form of an annular disc having an aperture 42 that surrounds an inflation opening 44 (see FIG. 2) in the polymer sheet 12. The inflation plate 40 may be formed of a polymer, and may be glued or otherwise adhered to the polymer sheet 12.

As best seen in FIG. 3, the inflation plate 40 receives the end 46 of an inflation tube 48 for air communication through the aperture 42. This may be accomplished by an abutting relationship between the end 46 and inflation plate 40. However the end 46 can also fit over and closely surround the inflation plate 40. The inflation plate 40 is substantially rigid, i.e., it is sufficiently stiff that it is not substantially deformed by the engagement with the inflation tube 48 and supports and reinforces the upper polymer sheet 12 around the inflation opening 44.

Figure 4:
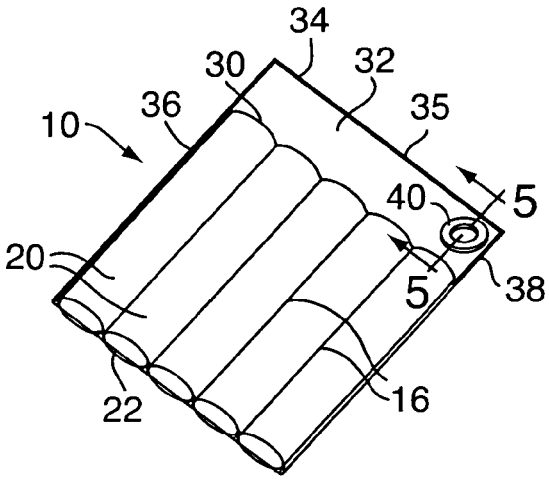
FIG. 4 is a perspective view of the inflatable packaging cushion of FIG. 1 in its inflated condition.
Figure 5:
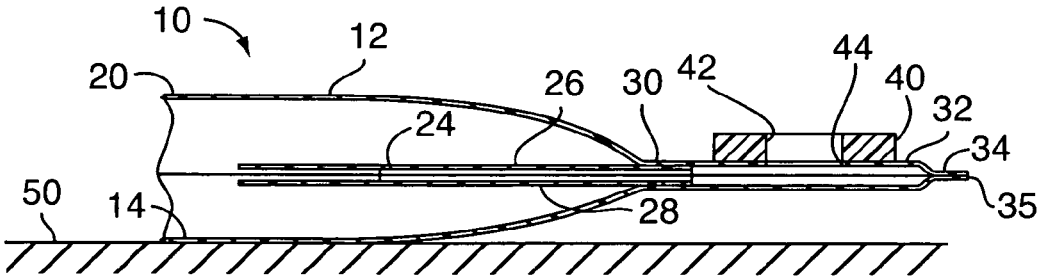
FIG. 5 is a sectional view of the inflatable packaging cushion of FIG. 1 in its inflated condition, taken along the lines of 5-5 of FIG. 4.
Figure 6:
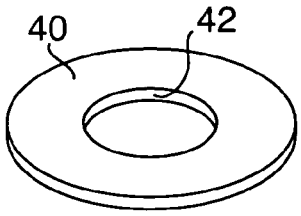
FIG. 6 is an enlarged fragmentary view of the inflation plate of the multi-chamber inflatable packaging cushion of FIG. 1.

With continued reference to FIG. 3, inflation air passes through the aperture 42 and inflation opening 44 to the interior of the manifold 32. This causes the portions of the upper polymer sheet 12 and lower polymer sheet 14 forming the manifold 32 to separate and fill with inflation air, which is then delivered to the individual inflatable chambers 20 through the inflation check valves 24. After the inflatable packaging cushion is inflated, the inflation tube 48 is disengaged from the inflation plate 40 and the manifold 32 merely collapses, as shown in FIGS. 4 and 5. The individual chambers 20, of course, remain inflated as they are sealed by the check valves 24 as shown in FIGS. 4 and 5.

In FIGS. 2 and 3, the manifold 34 is shown supported on a support surface 50, which may be a table or the like. The end 46 of the inflation tube 48 may be engaged with the inflation plate 40 when the inflatable packaging cushion 10 is on the support surface 50 in its uninflated condition such as shown in FIG. 2, and the inflation air delivered by the inflation tube causes the inflation plate 40 and top layer of polymer sheet 12 forming the manifold to separate to the position shown in FIG. 3 and to inflate chambers 20 of the inflating the packaging cushion 10. This occurs without any manual manipulation of the inflatable packaging cushion 10, other than the placement of the end of the inflation tube 48 on the inflation plate 40 such that air enters the aperture 42 and inflation opening 44. Therefore manual inflation of the packaging cushion 10 can be performed with one hand, by merely placing the inflation tube 48 in the proper position.

Perhaps more importantly, the inflatable packaging cushion 10 with inflation plate 40 is adapted for automated inflation, which is achieved by placing the packaging cushion 10 with the inflation plate 40 in a predetermined location and providing means for placing an inflation tube in air communication with the aperture 42 of the inflation plate 40 with the packaging cushion 10 in that predetermined location. This can be accomplished by packaging machinery at a packaging facility, with the inflatable packaging cushions 10 being filled in the vicinity of their use.

Figure 7:
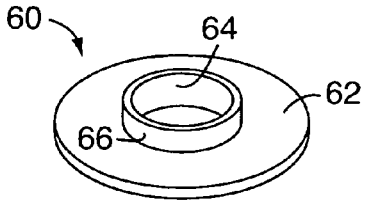
FIG. 7 is a enlarged fragmentary view of another inflation plate of the multi-chamber inflatable packaging cushion of FIG. 1.
Figure 8:
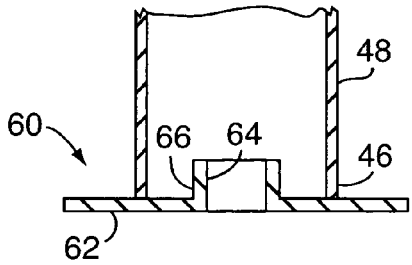
FIG. 8 is a sectional view of the inflation plate of FIG. 7, engaged with an inflation tube.

The inflation plate 40 in the form of an annular disc is but one of many shapes of inflation plates that may be used in invention. With reference to FIGS. 7 and 8, an inflation plate 60 is shown is characterized by an annular disc 62 having an aperture 64, and a placement flange 66 surrounding the aperture 64. As best illustrated in FIG. 8, the placement flange 66 extends into the distal end 46 of the inflation tube 48, such that the inflation tube 48 will not slip from its desired location on the inflation plate 60. The placement flange 66 is shown in tubular form, but may be discontinuous if desired.

Figure 9:
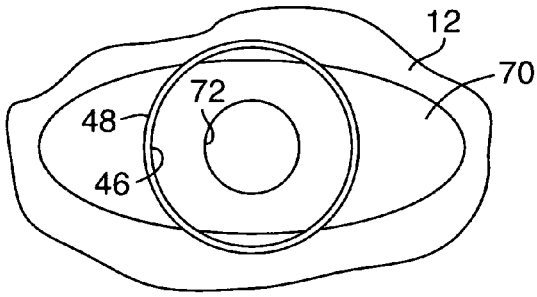
FIG. 9 is a plan view of another inflation plate for the multi-chamber inflatable packaging cushion of FIG. 1, with an inflation tube, shown in section, placed thereon.

With reference to FIG. 9, an inflation plate 70 is shown in an elongated shape with a central inflation aperture 72. The elongated portions of the inflation plate 70 engage the end 46 of the inflation tube 48.

Figure 10:
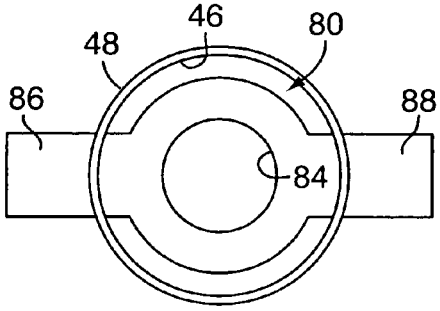
FIG. 10 is a plan view of another inflation plate for the multi-chamber inflatable packaging cushion of FIG. 1, with an inflation tube, shown in section, placed thereon.

Another inflation plate 80 is shown in FIG. 10, and has a centrally located annular disc 82 and aperture 84. The inflation plate 80 is characterized by two extensions 86 and 88, which increase the target area for the end 46 of the inflation tube 48.

Of course, any of the inflation plates may be provided with a placement flange, such as placement flange 66, in continuous or discontinuous form.

Figure 11:
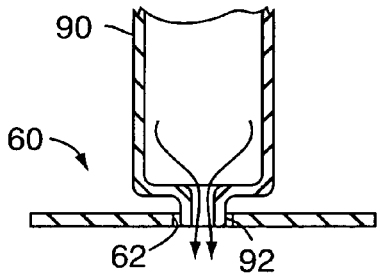
FIG. 11 is a side elevation view of an alternative inflation tube for use with the inflatable packaging cushion of FIG. 1.

As an alternative to a placement flange 66, FIG. 11 shows an inflation tube 90 having a projecting tip 92 sized and adapted to be received in the aperture 62 of an inflation plate 60. This alternative also maintains the positioning between the inflation tube and the inflation plate 60 during inflation of the inflatable packaging cushion 10, and otherwise operates similarly to the embodiments described above in lifting the inflation plate and filling the chambers 20.

Figure 12:
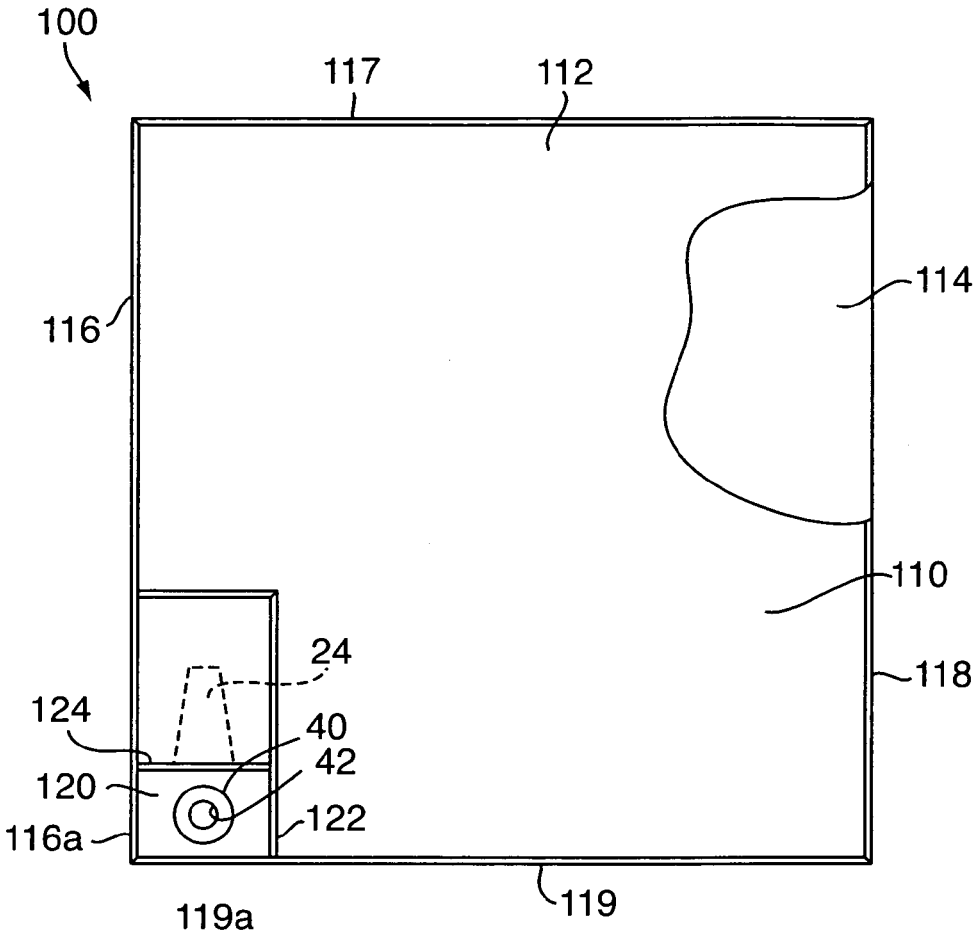
FIG. 12 is a plan view of a single chamber inflatable packaging cushion according to the invention herein.

With reference to FIG. 12, a single chamber inflatable packaging cushion 100 is shown, utilizing the inflation configurations and methods described above. The inflatable packaging cushion 100 has an inflatable chamber 110 formed between two sheets 112, 114 of polymer material joined at their perimeters by folds or seams 116, 117 and 119. An inflation manifold 120 is formed by portion 116*a* of seam 116, portion 119*a* of seam 119 and by seams 122 and 124. Seam 124 also mounts an inflation check valve 24, for delivering air from the inflation manifold 120 to the inflation chamber 110. The inflation manifold 120 has an inflation plate 40 secured thereto, with an aperture 42 and the polymer sheet 114 has a registered inflation opening therethrough. Thus, the inflatable chamber 110 may be filled by placing the end 46 of an inflation tube 48 on the inflation plate 40, which will fill the manifold 120 and deliver inflation air through the check valve 24 in the manner described above.

Accordingly, a multi-chamber inflatable packaging cushion has been described with various inflation plates, that admirably achieve the objects of the invention herein. It will be appreciated that the embodiments described are exemplary, and that various changes may be made without departing from the spirit and scope of the invention.

We claim:

1. An inflatable packaging cushion comprising:

A) at least one inflatable chamber formed between two juxtaposed sheets of polymer material;

B) an inflation manifold formed between the two juxtaposed sheets of polymer material adjacent the at least one inflatable chamber, the juxtaposed sheets disposed in contacting facing relationship when the inflatable packaging cushion is placed in uninflated condition on a support surface;

C) an inflation air check valve disposed between the inflation manifold and the at least one inflatable chamber for delivering inflation air from the inflation manifold to the inflatable chamber and for sealing the at least one inflatable chamber after inflation thereof;

D) an inflation plate secured to one of the two sheets of polymer material juxtaposed and closely above the other of the two sheets of polymer material when the inflatable packaging cushion is placed in uninflated condition on a support surface, the inflation plate having an aperture therethrough registered with an inflation opening to the inflation manifold, the inflation plate adapted to establish air communication with the end of an inflation tube for delivering inflation air through the aperture and inflation opening whereby inflation air delivered through the aperture separates the two sheets of polymer material and passes through the inflation air check valve to inflate the at least one inflatable air chamber.

2. An inflatable packaging cushion as defined in claim 1 wherein the inflation plate is sized and configured to receive the end of an inflation tube thereon.

3. An inflatable packaging cushion as defined in claim 2 wherein the inflation plate is annular.

4. An inflatable packaging cushion as defined in claim 2 wherein the inflation plate is elongated.

5. An inflatable packaging cushion as defined in claim 2 wherein the inflation plate has an upstanding placement flange around the aperture.

6. An inflatable packaging cushion as defined in claim 5 wherein the placement flange is continuous.

7. An inflatable packaging cushion as defined in claim 5 wherein the placement flange is discontinuous.

8. An inflatable packaging cushion as defined in claim 1 and further comprising an inflation tube having an extending tip sized and configured to be received in the aperture of the inflation plate.

9. An inflatable packaging cushion as defined in claim 1 wherein the at least one inflatable chamber comprises a plurality of inflatable chambers each inflatable chamber having an inflation air check valve disposed between it and the inflation manifold.

10. An inflatable packaging cushion as defined in claim 9 wherein the inflation plate is sized and configured to receive the end of an inflation tube thereon.

11. An inflatable packaging cushion as defined in claim 10 wherein the inflation plate is annular.

12. An inflatable packaging cushion as defined in claim 10 wherein the inflation plate is elongated.

13. An inflatable packaging cushion as defined in claim 10 wherein the inflation plate has an upstanding placement flange around the aperture.

14. An inflatable packaging cushion as defined in claim 13 wherein the placement flange is continuous.

15. An inflatable packaging cushion as defined in claim 13 wherein the placement flange is discontinuous.

16. An inflatable packaging cushion as defined in claim 9 and further comprising an inflation tube having an extending tip sized and configured to be received in the aperture of the inflation plate.

* * * * *